United States Patent [19]

Fleischer

[11] 4,253,658

[45] Mar. 3, 1981

[54] FOLDING JUVENILE CHAIR ATTACHABLE TO A TABLE TOP

[76] Inventor: Henry Fleischer, 18 Notch Park Rd., Little Falls, N.J. 07424

[21] Appl. No.: 26,031

[22] Filed: Apr. 2, 1979

Related U.S. Application Data

[62] Division of Ser. No. 758,799, Jan. 12, 1977, Pat. No. 4,160,553.

[51] Int. Cl.[3] ..... A63G 1/12

[52] U.S. Cl. ..... 272/33 R; 297/130; 297/174

[58] Field of Search ..... 297/174, 135, 130; 248/601, 162.1; 108/136; 272/33 R, 33 A, 33 B, 36, 40, 41, 42, 50

[56] References Cited

U.S. PATENT DOCUMENTS

| | | | |
|---|---|---|---|
| 76,801 | 4/1868 | Nichols | 297/130 |
| 85,050 | 12/1868 | Apel | 297/174 |
| 149,459 | 4/1874 | Flint | 297/174 X |
| D. 209,911 | 1/1968 | Cooper | 297/135 UX |
| 796,353 | 8/1905 | Rasmussen | 297/174 X |
| 1,022,767 | 4/1912 | Beistle | 297/130 X |
| 1,058,655 | 4/1913 | Bates et al. | 248/601 |
| 1,170,594 | 2/1916 | Young | 297/174 |
| 1,270,729 | 6/1918 | Harris | 248/601 |
| 1,358,640 | 11/1920 | Koyama | 108/136 X |
| 1,389,940 | 9/1921 | Erbeau | 297/130 X |
| 1,515,903 | 11/1924 | Nagorski et al. | 272/33 R |
| 1,937,254 | 11/1933 | Stoll | 248/601 |
| 3,222,104 | 12/1965 | Remington et al. | 297/174 X |
| 3,432,039 | 3/1969 | Howitt | 108/136 UX |

FOREIGN PATENT DOCUMENTS

| | | | |
|---|---|---|---|
| 14557 | of 1886 | United Kingdom | 108/136 |

*Primary Examiner*—Richard C. Pinkham
*Assistant Examiner*—Arnold W. Kramer

[57] ABSTRACT

A juvenile chair has a seat portion, a back rest connected to the seat, two front legs and two back legs with each leg being pivotally connected to the seat portion. A pair of braces is included each of which respectively connects a front and back leg on each side of the chair. A cross brace removably connected to the pair of braces holds the legs in normal chair position, or on disconnection can be reconnected to the braces when the legs are pivoted upward so that they extend above the seat. A juvenile table having a table top, a joint and a support base is provided with the joint connecting the table top to the base. The joint has an outer sleeve with resilient flexible support structure disposed therein and spaced from the internal walls of the sleeve and connected to the table top so that the table top is free to move up and down, rock from side to side, or rotate. Carrier supports attached to the underside of the table, receive the cross brace of the juvenile chair when the legs are folded upwardly whereby a plurality of similar juvenile chairs can be pivotally attached to the table and the combination used as a merry-go-round.

9 Claims, 25 Drawing Figures

FIG.3
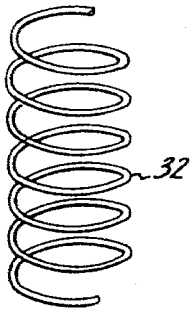
FIG.4
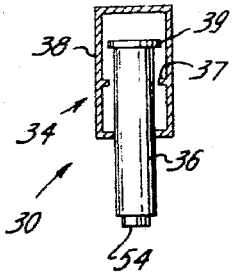
FIG.5
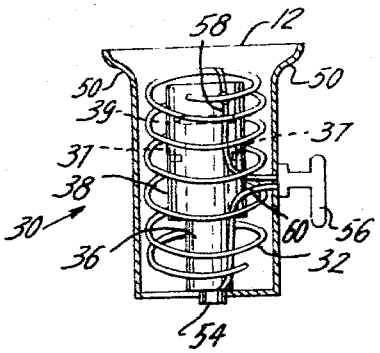
FIG.6
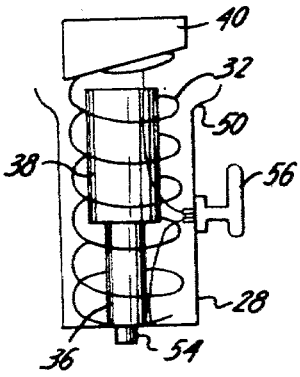
FIG.6A
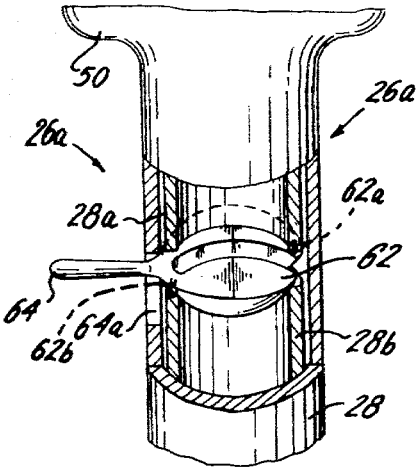
FIG.6B
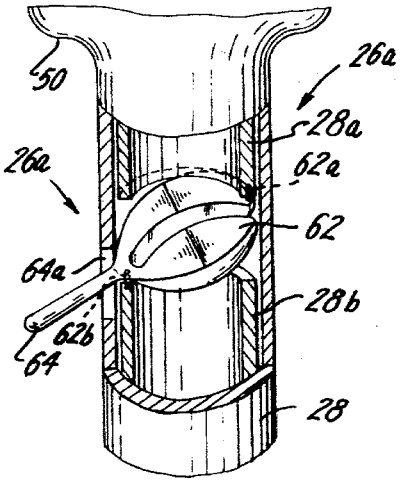
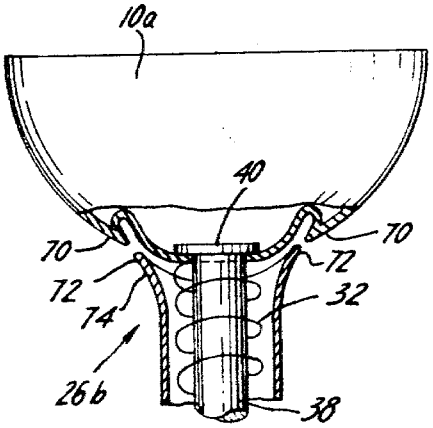
FIG.7
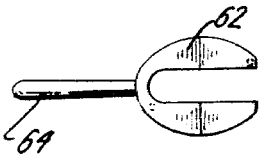
FIG.6C
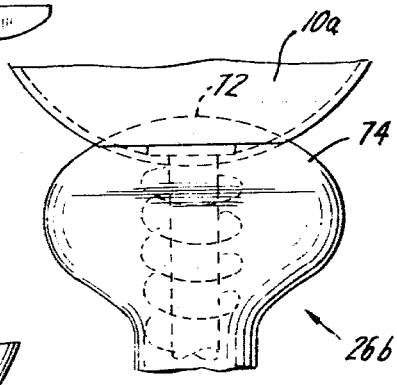
FIG.8
FIG.9
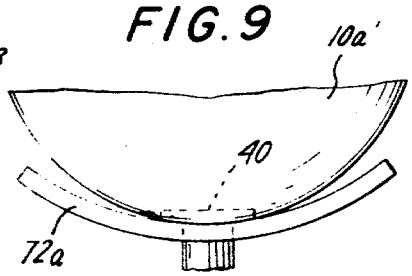

FIG. 10
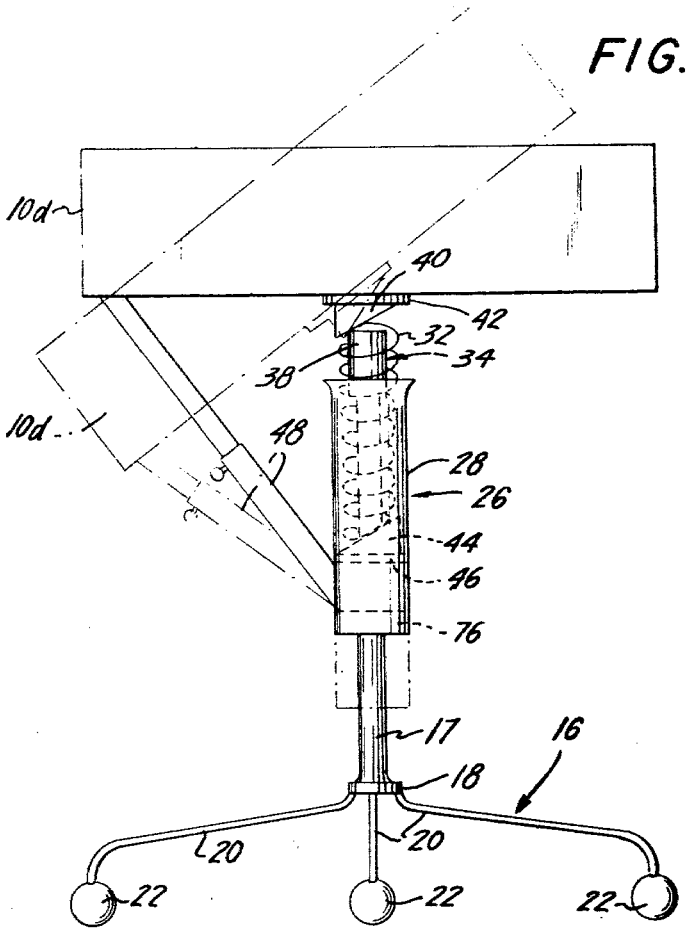
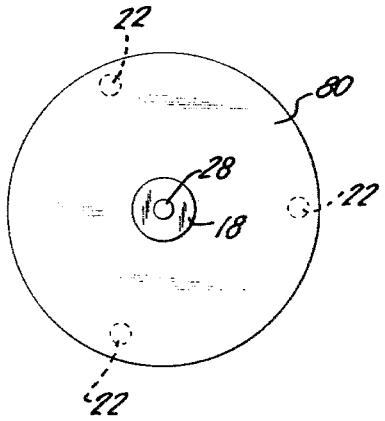
FIG. 11
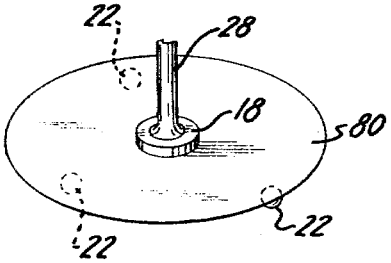
FIG. 12

FIG. 13
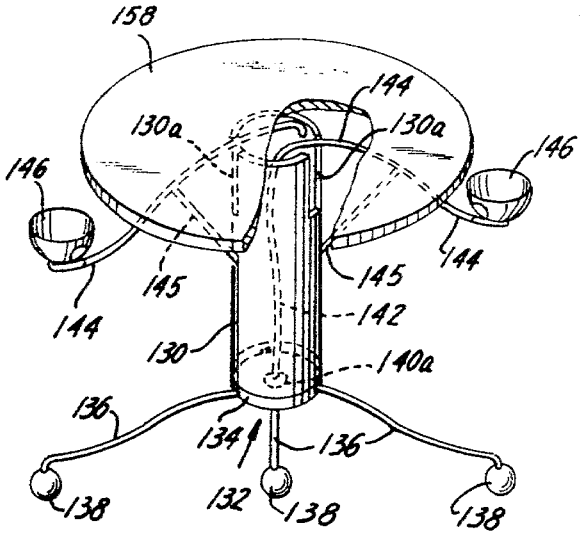
FIG. 14
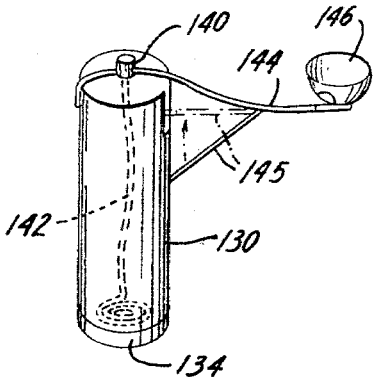
FIG. 15
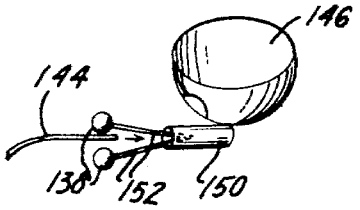
FIG. 16
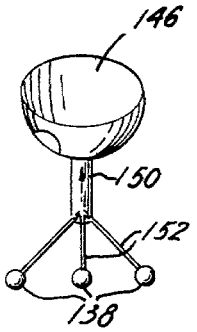
FIG. 18
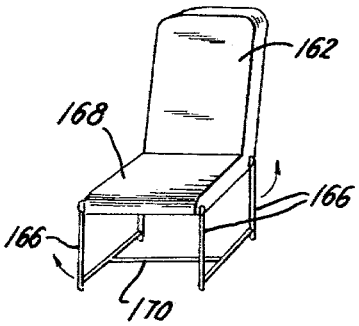
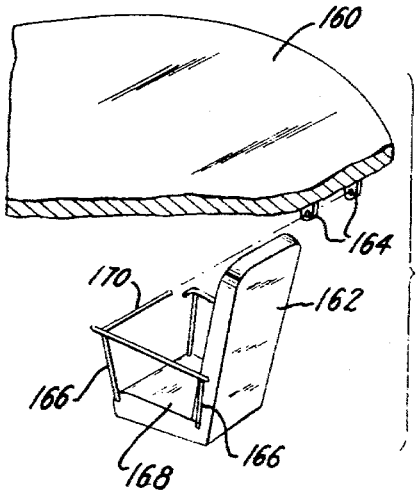
FIG. 20
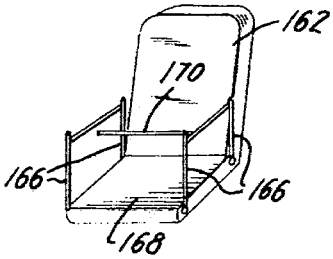
FIG. 19

FOLDING JUVENILE CHAIR ATTACHABLE TO A TABLE TOP

REFERENCE TO OTHER APPLICATIONS

This application is a division of application Ser. No. 758,799, filed Jan. 12, 1977, now U.S. Pat. No. 4,160,553.

FIELD OF THE INVENTION

The present invention relates to a unique joint which permits a child in a carrier, such as a walker, to rock back and forth, sway from side to side, swivel, jump up and down and tilt between horizontal and vertical, and to various items or systems of furniture and playthings incorporating such joint.

BACKGROUND OF THE INVENTION

Young parents or grandparents shopping for walkers, high chairs, strollers, rockers, car beds, car seats, cribs, carriages, chairs, swings, bathinettes and other baby holding and amusement devices are certain to experience frustration and confusion in trying to decide on their purchase. They are confronted with an almost endless choice of individual items of specific function and utility. If storage facilities and expense are of no great concern, they might buy all of the above items; all are important at one time or another for utilitarian and/or amusement purposes. But what of the great masses of parents to whom money and storage space are major problems? Obviously, those living in apartments and under strict budgets cannot afford all of the above items. It is to these parents of average means and limited storage space that the present invention is primarily directed.

The present invention provides a unique joint which may be used as part of a system with one, two or three or more different child holding devices or carriers and various wheeled or wheeless supports or bases therefor. The system comprising the above components are relatively inexpensive and require significantly less storage space as compared with the many individual items mentioned above and provide all of the needs and functions of such individual items, and more.

Furthermore, with respect to walkers for pre-walking children, those available until now have been useful primarily in allowing the child to move from one point to another providing minimal amusement to the child.

The unique joint or stem of the invention when employed in a walker makes available to the child seated therein not only locomotion but almost endless variations on motion and amusement as well. As will be seen hereinafter, the walker incorporating the unique joint of the invention will rock, bounce up and down, sway or swing from side to side and back and forth, tilt and be positioned at any desired angle between horizontal and vertical and back to its normal vertical position, and turn or spin 360° in either direction. The parent may lock the walker in any desired altitude including in a normal locked position so that the walker functions strictly as does a conventional walker or even in a rigid position where no movement of any kind is desired.

Accordingly, it is seen that the unique joint of the invention when employed in a walker or other type system will provide an economical solution and substitute for the myriad types of child holding and amusement apparatus usually required for the average active, curious child.

BRIEF STATEMENT OF THE INVENTION

In accordance with the present invention, there is provided a unique joint or stem adapted to be used in a child holding, carrying and/or amusement system in conjunction with a child holding device (or carrier) and a wheeled and/or wheeless support or base for such carrier. The unique joint or stem of the invention generally comprises a spring-shock arrangement which includes an outer tubular casing or sleeve, resilient means, such as a spring, disposed within said outer sleeve, and a resilient, flexible springy rod member disposed within the spring means. The resilient, flexible springy rod member may take the form of a miniature shock absorber of the piston-cylinder type. The spring-shock arrangement and/or sleeve will include upper locking means to secure the spring-shock arrangement to a child holding device (hereinafter referred to as a "carrier") and lower locking means to secure the spring-shock arrangement to a wheeled or wheeless lower support or base for the carrier. The spring-shock arrangement, carrier or lower support may also include swivel means to allow rotation of the carrier about the sleeve and/or the base.

The unique joint will preferably include locking means to lock the carrier into a fixed position on the base; the locking means may include control means, such as a handle, disposed externally to the spring-shock arrangement for easy access. The control means is connected by means of connecting members to each of the ends of the spring or to each of the upper and lower locking means. The control means thus may be operated to compress the spring means causing the carrier attached to the upper end of the spring-shock arrangement to be moved downwardly against the upper end of the sleeve (housing the spring-shock arrangement). The sleeve acts as a stop thereby fixing the position of the carrier against any movement vis-a-vis the spring-shock arrangement and base and thereby preventing any movement of the carrier itself. Operation of the control means to allow the spring means to be extended causes the carrier to be lifted upwardly and away from the sleeve and spring-shock arrangement thereby freeing the carrier to effect any or all of the motions described above.

As described herein, the unique joint or stem may be used in conjunction with carriers which function as cribs, carriages, walkers, car beds, car seats, strollers, rockers, bathinettes, infant seats, chairs, swings, and the like as well as with any types of wheeled or wheeless bases or supports therefor as will be described in more detail hereinafter. In addition, a heavy duty version of the unique joint of the invention together with heavy duty carriers and bases may be employed as playground equipment or even as gym or exercising equipment for adults.

BRIEF DESCRIPTION OF THE FIGURES

FIGS. 3 and 4 are schematic views of the spring means and shock, respectively, employed in the joint of FIG. 2;

FIG. 5 is a schematic view of the joint of FIG. 2 in its closed, rigid or compressed position;

FIG. 6 is a schematic view of the joint in its open flexible position;

FIGS. 6A, 6B and 6C are schematic views of alternate control means for the joint shown in FIG. 2;

FIG. 7 is a partial schematic of the upper portion of an alternate embodiment of the joint of FIG. 2;

FIG. 8 is a side view of the embodiment shown in FIG. 7;

FIG. 9 is a fragmentary view of the joint of the invention showing alternative tilt control means for the carrier;

FIG. 10 is a schematic view of a bathinette, cradle or carriage type carrier incorporating the unique joint of the invention as shown in FIG. 2;

FIGS. 11 and 12 are plan and perspective views, respectively, of bases which may be employed with the joint of FIG. 2;

FIG. 13 is a schematic view of a table-carrier arrangement which functions as a merry-go-round, and incorporates the unique joint of the invention;

FIG. 14 is a view of a portion of the arrangement shown in FIG. 13;

FIGS. 15 and 16 are schematic views of the carriers employed in the arrangement shown in FIG. 13;

FIGS. 18 to 20 are schematic views of chairs which may be employed in the arrangement shown in FIG. 17;

DETAILED DESCRIPTION OF FIGURES AND PREFERRED EMBODIMENTS OF THE INVENTION

Figure 2:
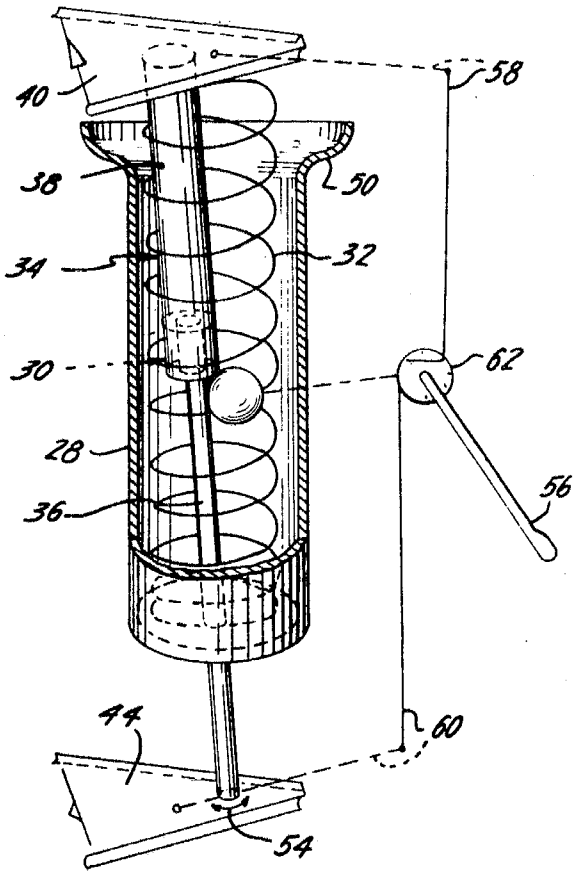
FIG. 2 is a schematic view of the unique joint of the invention, by itself, including locking means for securing a carrier (such as a walker-carrier) and base to the joint.

Referring to the accompanying FIGS. wherein like numerals represent like parts in the several views. FIGS. 1 to 6 illustrate a pre-walking child walker-bouncer (FIG. 1) indicated generally by the numeral 10, which includes the unique joint (best shown in FIGS. 2 to 6) in accordance with the present invention, indicated generally by the numeral 26. The walker 10 includes a carrier 12 formed of hard or soft plastic, fabric, canvas and the like (which may be provided with a foldable frame, if desired, not shown for drawing clarity) and provided with leg openings 14 as shown. A support or base section indicated generally by the numeral 16 is connected to the carrier 12 by means of the hollow sleeve or shaft 28 (which may be of the telescoping type and adjustable to and fixed at any desired height, not shown for drawing clarity). Hub 18 is disposed at the lower end of shaft 28 and is connected to legs 20 each of which carries one or more wheels, rollers or casters 22 removably and rotatably connected thereto.

Figure 1:
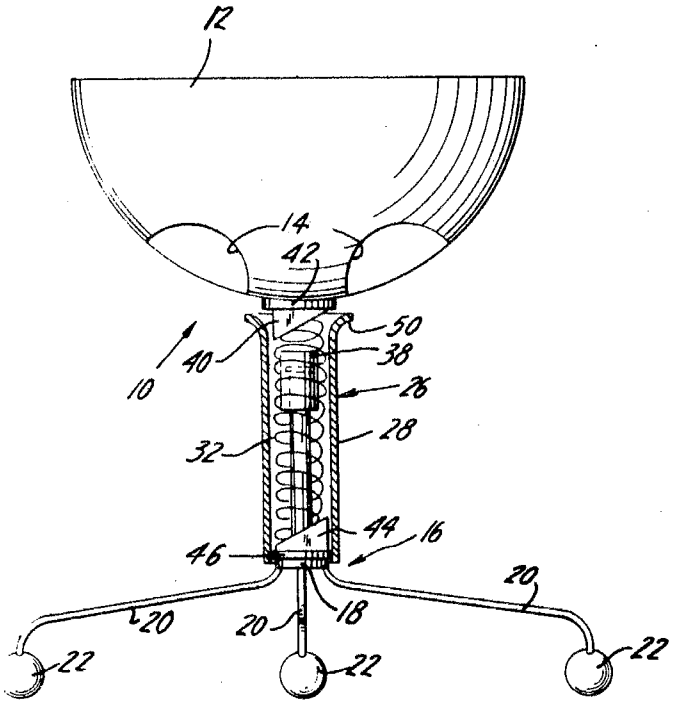
FIG. 1 is a schematic view of a walker including the unique joint or stem of the invention.

The joint 26, as best shown in FIG. 2 includes the outer casing or sleeve 28 within which is disposed spring-shock arrangement 30 (best seen in FIGS. 3 and 4). The spring-shock arrangement 30, as shown, includes spring 32 which encircles a resilient flexible compressible rod member which may take the form of a miniature shock absorber 34 of the piston-cylinder type including cylinder 38 from which extends piston 36. As is best seen in FIG. 4, the upper end of cylinder 38 is equipped with stops 37 while the piston 36 includes stops 39, the stops 37, 39 controlling the degree of extension of the piston from the cylinder and thereby limiting up and down bouncing motion. The upper ends of each of the spring 32 and the cylinder 38 are connected to upper (or carrier) locking member or wedge 40 which fits into and connects with corresponding securing means 42 of carrier 12 as best shown in FIG. 1. The lower end of each of the piston 36 and spring 32 are connected to base locking member or wedge 44 which fits into and connects with corresponding securing means 46 disposed within or connected to hub 18 of the base 16 as seen in FIG. 1.

The upper and lower locking members 40 and 44 and their respective securing means 42 of the carrier and 46 of the base may take the form of conventional tongue-groove, hook and eye, bayonet, screw threads, nuts and bolts, or other convenient locking mechanism. It will also be appreciated that the ends of the spring 32 and the ends of each of the piston 36 and cylinder 38 may be connected to members disposed at such ends which do not necessarily function as components in the locking system.

It will now be seen that the walker 10 of FIG. 1 is capable of providing various types of movement for a child. The spring 32 and shock absorber 34 allow for up and down or bouncing motion limited by the distance between the stops 37, 39. Inasmuch as the sleeve 28 is substantially wider than the shock-spring arrangement disposed therein, the child may also sway from side to side or rock back and forth, such movement being limited by the space between the spring-shock arrangement and the sleeve 28. The rocking or back and forth motion and/or the swaying side to side motion may also be controlled by providing a flared end portion 50 at the upper end of sleeve 28; the flared end 50 will contact the bottom portion of carrier 12 thereby restricting such motion. It will be seen that the flared portion 50 may completely encircle the sleeve 28 or project from any portion thereof at varying degrees so that movement may be varied from side to side and/or back and forth, as well as tilting from horizontal to vertical, or any attitude therebetween.

In order to provide 360° (or any portion thereof) spinning or turning motion, the hub 18 of the base 16 and/or joint 26 itself and/or the sleeve 28 and/or securing means 42 of the carrier 12 may be provided with swivel means such as a swivel joint including ball bearings. In the accompanying FIGS. 1 to 6, the swivel means 54 is connected to the bottom of piston 36. Where two or more swivel joints are provided, for example, one at the hub 18 and one at the bottom of carrier 12, the carrier may spin in one direction while the base 16 spins in the other direction. Furthermore, the shaft 28 (when extendable) may be raised or lowered so that the child may be safely suspended from the carrier and may thereby experience swinging motion as well.

Accordingly, it will be seen that the walker of FIG. 1 may provide any number of different types of motion to a child safely seated and secured in the carrier 10.

The walker 10 may also be locked into position on the base so that it functions as a conventional walker. This may be accomplished by providing the joint 26 with control means which may take one of many forms. The control means will function to move the carrier 10 flush against the sleeve 28 of the joint 26 or lock the spring 32 in a completely extended or depressed state. One such control means is shown best in FIGS. 2, 5 and 6 and includes control handle 56 which in FIG. 2 has been displaced from the sleeve 28 for drawing clarity. The handle 56 is disposed externally to sleeve 28 for easy access. The handle 56 is connected to control members 58 and 60 (best shown in FIGS. 2 and 5) preferably disposed within sleeve 28 which in turn are connected to locking members 40, 44, respectively. Alternatively, the control members 58, 60 may be connected to the ends of spring 32 and/or to the piston 36 and cylinder 38, respectively. As the handle 56 is rotated downwardly (clockwise in FIG. 2), the control members 58, 60 cause the carrier 10 to move downwardly toward the base 16 causing spring 32 and shock absorber 34 to be compressed until the bottom of the carrier contacts the upper end of the sleeve 28. It will be apparent that depending upon the position of handle 56, various degrees of compression of the spring-shock arrangement can be attained to allow for various types of action or movement. Thus, as seen in FIG. 2, the handle 56 can be employed in conjunction with a control dial 62 so that the handle may be set at any position to provide any desired degree of compression and resulting action between and including bounce, all movements, rock, swivel and lock. Moving the handle 56 upwardly (counter-clockwise) to the position shown in FIG. 6 allows the spring 32 and shock 34 to rise lifting the carrier 10 upwardly to the free-moving position away from the upper end of the sleeve 28.

It will also be appreciated that the handle 56 may be connected to locking cables connected to the wheels, rollers, or casters 22 to lock same into place at the same time the carrier is locked into place or while the carrier is in the "free-moving" position. However, separate locking means may be employed to lock the wheels, rollers, or casters which locking means may be located near the top or bottom of the carrier 10 or at the base 16 for convenience. In fact, when the wheels are locked into position, and the telescoping sleeve 28 is extended to lift the carrier 2 to 4 feet from the floor, the walker may be employed as a high chair.

Referring now to FIGS. 6A, 6B and 6C, there is illustrated joint **26*a* in accordance with the invention containing alternate control means which may be employed in liew of the handle 56—control members 58 and 60 of FIGS. 2 to 6. In the control means of FIGS. 6A and 6B, the sleeve 28 is split into two sections, upper section 28*a* and lower section 28*b*, lower section 28*b* overlapping upper section 28 as shown. Disposed within the sleeve sections 28*a*, 28*b* are the spring-shock arrangement and associated components as described with respect to FIG. 2. Off-centered control device 62, a lift member which may take the form of a horseshoe-shaped member disposed about the spring-shock arrangement (so as not to interfere with the functioning of same) (or other convenient device such as off-centered cams and the like) best shown in FIG. 6C, is pivotally connected to upper section 28*a* at pivot 62*a* and is pivotally connected to lower section 28*b* at pivot 62*b* as shown in FIGS. 6A and 6B. Handle 64 of control device 62 passes through slot 64*a* in sleeve 28 as shown and may be used to raise or lower the control device 62 to thereby move the sections 28*a*, 28*b* with respect to each other for purposes described below. Thus, as seen in FIG. 6A where the sections 28*a*, 28*b* are in their normal working position, the spring-shock arrangement will be in their working-action position. However when the off-centered control device 62 is raised (by lowering handle 64) to the position shown in FIG. 6B, the section 28*a* is moved away from section 28*b* to an extended position which causes the spring 32 and shock 34 to be extended to and fixed at their outermost limits thereby neutralizing any spring and shock action and fixing and locking a carrier 10 (connected to joint 26*a*) in place so as to prevent movement of the carrier 10 vis-a-vis the base 16**.

It will also be appreciated that the control means shown in FIGS. 6A, 6B and 6C may be employed in a manner similar to the control means of FIG. 2. In such case, the joint **26*a* may be designed so that sections 28*a* and 28*b* are held apart by the off-centered control device 62 (as shown in FIG. 6B) albeit not so far apart as to neutralize the action of the spring-shock arrangement so that the carrier 10 may be made to move vis-a-vis the base. When it is desired to lock or fix the carrier, the off-centered control device 62 having control members 58, 60 (shown in FIGS. 2 and 5) may be moved to the position shown in FIG. 6A. The weight of the child in the carrier and the action of the control members 58, 60 will cause the carrier to be moved down against the flared portion of sleeve 28** thereby causing the spring-shock arrangement to be compressed thereby preventing any undesired motion of the carrier with respect to the base.

Referring now to FIGS. 7 and 8, there is shown another embodiment of a walker-type device which includes special tilt control means. In FIG. 7, there is shown a carrier **10*a* connected to the upper portion of joint 26*b* through cylinder 38 via locking means 40. The bottom of carrier 10*a* includes grooves or recesses 70 designed to receive the flared ends 72 of the upper portion 74 of sleeve 28. In the position shown in FIG. 7, the carrier 10*a* is designed to tilt from side to side depending on the space between the bottom of the carrier 10*a* and the flared ends 72 of sleeve 28. Where it is desired to prevent tilting or swaying of the carrier, the sleeve 28 is raised (or spring 32 is compressed) as by control means as described hereinbefore until the flared ends 72 engage the grooves 70 in the carrier 10*a*. In one embodiment, the grooves 70 may take the form of a pair of spaced apart grooves or tracks each groove adapted to engage or receive a portion of the flared ends 72 of sleeve 28. FIG. 8 shows the sleeve 28 so engaged to prevent tilting of the carrier 10*a* relative to the flaired ends 72 of sleeve 28**.

FIG. 9 illustrates another embodiment of the present invention for controlling undesired tilting of the carrier **10*a*'. In FIG. 9, the bottom of carrier 10*a*' is designed so that it is of a substantially smaller arc (or radius or circumference) than the flared end 72*a* of the sleeve 28. The rocking or swaying motion of the carrier 10*a*' will thus be limited by the space between the ends of the flared ends 72*a* of sleeve 28 and the sides (of the bottom) of the carrier 10*a*'**.

As indicated hereinbefore, the unique joint of the invention may be employed in conjunction with any number of different carriers and bases. FIG. 10 illustrates the joint 26 (of FIG. 2) employed with a cradle, car bed type carrier **10*d* which is removably attached to joint 26, via locking components 42, 40; joint 26 is connected to a shaft 17 (disposed below sleeve 28) via locking components 44, 46 (in a manner similar to that described hereinbefore) which shaft 17 is connected to base 16 through hub 18. Legs 20 carrying wheels, rollers, or casters 22 are connected to hub 18 as previously described. The shaft 17 will preferably be of the telescoping type so that it may be adjusted to any desired length and locked in place by means of locking nut 76**.

The carrier 10*d* of FIG. 10 may also be pivotally connected to the shaft 17 and joint 26 and supported by brace 48 at any desired angle to the shaft 17 to form a crib, high chair, youth chair, carriage, stroller, car bed, and the like. Thus, the brace 48 may be telescoping, or collapsible or may slide in a vertical slot in shaft 17 or sleeve 28 to allow for such positioning.

As seen in FIGS. 11 and 12 the base 16 may take different forms which are interchangeable with the various carriers and bases. Thus, the base as shown in FIGS. 11 and 12 may have a flat surface 80 having rollers or casters directly attached thereto.

It will also be appreciated that the joint 26 shown and described above may be modified to substitute a torsion bar for the spring-shock arrangement. In addition, spring steel, small groups of springs, or other resilient compressible-expandable members may be employed in conjunction with and/or in place of the spring-shock arrangements or components thereof.

Turning now to FIGS. 13, 14, 15, 16, there is shown a child's plaything suitable for use by one or more children at the same time which, in essence, brings the playground into the child's house and provides a merry-go-round, lady bug (bounces up and down), sway motion (side to side), rocker, table, and chair and with the table removed provides a see-saw like apparatus. The chairs and table may be detached from one another and used separately.

Referring now to FIGS. 13 and 14, the child's plaything includes a tubular member or stem 130 which is removably connected to base 132 through hub 134. Legs 136 carrying wheels, rollers or casters 138 extend from hub 134 as shown. A swivel 140 (shown in FIG. 14) may be disposed at the top of stem 130 and/or a swivel 140*a* may be provided at the bottom of stem 130 to provide spinning or turning motion in the manner of a merry-go-round. Disposed within the stem 130 is a torsion bar 142 or spring steel or a spring-shock arrangement as described hereinbefore with respect to FIG. 2. As shown, one or more torsion bars 144 extend through slots 130*a* in stem 130 and are anchored to the torsion bar 142 and/or to upper internal surfaces of the stem 130 as shown or to an extension of such stem 130. Lock arms 145 may be removably connected to the torsion bars 144. The lock arms 145 may slide up and lock under the table 158 (where used) for storage.

The lock arms 145 may be of telescoping or otherwise extensible design and may be connected at any desired point along the torsion bars 144 to pull down on the torsion bars 144 to thereby change the degree of torsion (or tension) on the carriers 146 connected to the torsion bars 144. In this manner, the degree of motion or mobility of the carriers 146 may be limited as desired. Thus, where it is desired to severely restrict motion of the carrier 146, the lock arms 145 may be connected to the carriers 146 themselves or to a portion of the torsion bars 144 near the carriers 146. If desired, a cable or other means may be used to connect the carriers and/or torsion bars 144 to the stem 130 to vary torsion and tension and thereby control and even stop torsion on the carriers. As shown in FIG. 15, the carrier 146 is adjustably and pivotally connected to hollow stem 150 and torsion bar 144 merely is inserted in hollow stem 150 which causes legs 152 to close inwardly (as an umbrella) and move into stem 150. The legs 152 of the carrier 146 are thus safely out of the way and will not injure a child seated in the carrier. The carrier is then merely pivoted from the position shown in FIG. 16 to that shown in FIG. 15 and locked into place. The apparatus of FIGS. 13 and 14 may now be used as a merry-go-round, see-saw, lady bug, rocker or to give swaying side to side motion.

If desired a table top 158 may be detachably connected by conventional means to the top of the stem 130 so as to provide a child's table and chairs combination.

It will now be appreciated that the torsion bars may be used to twist the table and chairs in one direction and then the tension of the torsion bars turn them back the other way. The torsion bars may also be used to control the amount of sway and up and down motion (in a manner similar to the torsion bars on trunk lids). Furthermore, a motor may be connected to the torsion bar 142 to cause it to turn, in turn causing the torsion bars 144 to turn.

Figure 17:
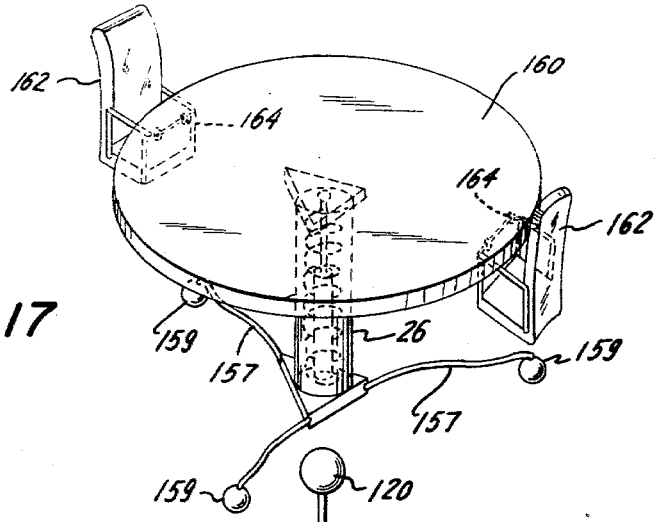
FIG. 17 is a schematic view of a table-chair arrangement incorporating the unique joint of the invention.

Turning now to FIGS. 17, 18, 19 and 20, there is shown another embodiment of a table-chair combination, see-saw, merry-go-round, lady bug, swayer, rocker combination. As shown in FIG. 17, a joint 26 such as employed in FIG. 2 connects a base 16 (including legs 157 and rollers 159) to a table top 160. Chairs 162 are connected to the table top 160 via brackets, locks, hooks or other conventional locking devices 164 disposed on the underside of the table top 160. As shown in FIGS. 18 and 19, the legs 166 of chair 162 are pivotally connected to the bottom of seat 168 of chair 162. Thus, upon removing cross brace 170, the legs can be pivoted upwardly as shown in FIG. 19 and the cross brace 170 can be used to engage hooks 164 or other supports on the underside of table top 160. Furthermore, the above design will allow the chair 162, once attached to the table top 160, to pivot 90° to allow entry of the child. If desired, the support 164 may be pivotally attached to the underside of the table top to allow for pivoting of the attached chair and subsequent entry by the child.

As will be apparent the chairs 162 may be detached from the table 160 and each of the chairs and table may be used independently of each other. Furthermore, when the chairs are attached to the table, any of the aforementioned motions (up, down, side to side, back and forth, and rocking) may be effected by the child.

Thus, it will be seen that there is provided in accordance with the invention a system of interchangeable bases and carriers which can be used as chairs, walkers, strollers, cribs, carriages, infant seats, bathinettes, swings, rockers, car beds, car seats, etc. wherein the carrier can be adjusted on the various bases to turn 360° in either direction, can be set at any angle from vertical to horizontal, fold flat (base and carrier), rock, bounce up and down, sway or swing back and forth or side to side, and includes a locking mechanism to lock carrier and base at any desired position including rigidly to each other when no movement is desired or any position between full movement and no movement.

Figure 21:
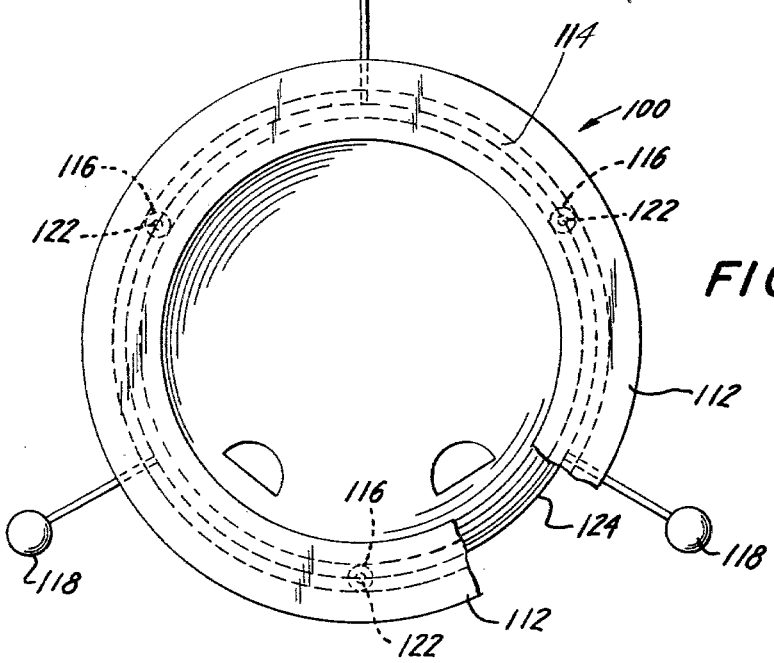
FIG. 21 is a plan view of another embodiment of a baby walker in accordance with the invention.
Figure 22:
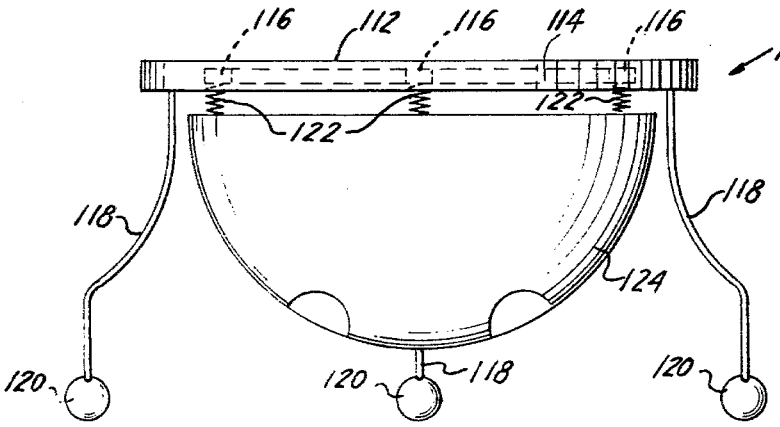
FIG. 22 is a side view of the walker shown in FIG. 21.

In another embodiment of a walker as shown in FIGS. 21 and 22, a frame 100 is provided which includes an annularly shaped circular support member 112, which includes a circular recess or grooved track 114 having rollers or ball bearings 116 disposed therein and adapted to rotate within and about the member 112. A series of legs 118 are connected about the member 112 and has wheels, rollers or casters 120 connected to each leg as shown. Connected to the rollers 116 are springs 122 which support a carrier 124 as shown. Thus, as will be apparent, the carrier can rotate 360° in either direction about track 114 and can rotate about the wheels, casters or rollers 120, bounce up and down, rock, sway back and forth, and roll. The wheels, rollers or casters 120 as well as the rollers 116 can be locked in place employing conventional means to stop all motion. In addition, the legs can be hinged to fold and lock flat and the carrier can be collapsed to fold flat.

What is claimed is:

1. A juvenile table combination comprising, in combination, a table top, a joint and a support base, said joint connecting said table top to said support base, said joint comprising, in combination, and outer sleeve, and resilient flexible means disposed within the outer sleeve and connected to said table top, said outer sleeve being sufficiently large so that said resilient flexible means is spaced from the internal walls of said outer sleeve and together with said table top is free to move up and down or rock from side to side, further including carrier attaching means connected to said table top for attaching one or more chairs to said table top, said carrier attaching means being disposed on the underside of said table top, and further including one or more juvenile chairs including means for engaging said chairs to said carrier attaching means, said juvenile chair including a seat portion, a back rest connected to said seat, two front legs and two back legs each leg being pivotally connected to the seat portion, a pair of braces, one brace connecting the left front and left back legs and one brace connecting the right front and right back legs and a cross brace removably connected to said pair of braces or to said front legs, so that said cross brace may be disconnected from said pair of braces or front legs, the four legs pivoted upwardly so that they extend above the seat portion, and said cross brace may engage the carrier attaching means disposed on the undersurface of said table top and thence attached again to said front legs or said pair of braces, whereby said chair is supported on or carried by said table top.

2. The juvenile table combination as defined in claim 1 wherein said resilient flexible means comprise coiled spring means.

3. The juvenile table combination as defined in claim 1 wherein said resilient flexible means comprise a shock absorbing member in the form of a piston-cylinder type shock absorber.

4. The juvenile table combination as defined in claim 3 wherein said shock absorber includes stop members limiting the extension of the shock absorber.

5. The juvenile table combination as defined in claim 1 wherein said resilient flexible means comprise one or more torsion bars or springs or spring steel.

6. The juvenile table combination as defined in claim 1 wherein said joint, table, and/or base support includes swivel means to allow said table top to rotate with respect to said joint and said base support.

7. The juvenile table combination as defined in claim 1 wherein said carrier attaching means includes carrier pivot means.

8. A juvenile table combination comprising, in combination, a table top, a joint and a support base, said joint connecting said table top to said support base, further including carrier attaching means connected to said table top for attaching one or more chairs to said table top, said carrier attaching means being disposed on the underside of said table top, and further including one or more juvenile chairs including means for engaging said chairs to said carrier attaching means, said chair including a seat portion, a back rest connected to said seat, two front legs and two back legs each leg being pivotally connected to the seat portion, a pair of braces, one brace connecting the left front and left back legs and one brace connecting the right front and right back legs and a cross brace removably connected to said pair of braces or to said front legs, so that said cross brace may be disconnected from said pair of braces or front legs, the four legs pivoted upwardly so that they extend above the seat portion, and said cross brace may engage the carrier attaching means disposed on the undersurface of said table top and thence attached again to said front legs or said pair of braces, whereby said chair is supported on or carried by said table top.

9. A juvenile chair adapted for attachment to carrier attaching means disposed on the undersurface of a table top, said chair comprising a seat portion, a back rest connected to said seat, two front legs and two back legs each leg being pivotally connected to the seat portion, a pair of braces, one brace connecting the left front and left back legs and one brace connecting the right front and right back legs and a cross brace removably connected to said pair of braces or to said front legs, so that said cross brace may be disconnected from said pair of braces or front legs, the four legs pivoted upwardly so that they extend above the seat portion, and said cross brace may engage carrier attaching means disposed on the undersurface of said table top and thence attached again to said front legs of said pair of braces, whereby said chair is supported on or carried by said table top.

* * * * *